US005536194A

United States Patent [19]

Larsen et al.

[11] Patent Number: 5,536,194

[45] Date of Patent: Jul. 16, 1996

[54] COLLAPSIBLE PINATA

[75] Inventors: David B. Larsen; Consuelo N. Larsen, both of Chula Vista, Calif.

[73] Assignee: Eastlake Manufacturing & Development, Inc., Chula Vista, Calif.

[21] Appl. No.: 374,466

[22] Filed: Jan. 18, 1995

[51] Int. Cl.[6] ..... A63H 33/00; A63H 33/30

[52] U.S. Cl. ..... 446/5; 446/475; 446/488; 229/108.1; 229/109; 229/117.04

[58] Field of Search ..... 446/5, 4, 475, 446/486, 487, 488, 490; 229/108, 108.1, 109, 110, 107, 117.04, 117.03; 472/54

[56] References Cited

U.S. PATENT DOCUMENTS

| | | | |
|---|---|---|---|
| 1,335,128 | 3/1920 | Richards | 229/117.03 X |
| 2,147,676 | 2/1939 | Shoemaker | 229/108 X |
| 3,661,319 | 5/1972 | Koehler . | |
| 3,702,675 | 11/1972 | Bajo . | |
| 4,015,363 | 4/1977 | Oquita . | |
| 4,089,417 | 5/1978 | Osborne | 229/109 X |
| 4,166,567 | 9/1979 | Beach, Jr. et al. . | |
| 4,167,078 | 9/1979 | Oquita . | |
| 4,186,514 | 2/1980 | Oquita . | |
| 4,253,266 | 3/1981 | Bajo . | |
| 4,418,861 | 12/1983 | McFarland et al. . | |
| 4,787,872 | 11/1988 | Bajo . | |
| 4,790,714 | 12/1988 | Schnapp | 446/486 |
| 4,793,546 | 12/1988 | Nunn | 229/110 X |
| 4,955,841 | 9/1990 | Pastrano | 446/487 X |
| 5,096,751 | 3/1992 | Duchek | 446/486 X |
| 5,242,308 | 9/1993 | Estrada | 446/5 X |

FOREIGN PATENT DOCUMENTS

| | | | |
|---|---|---|---|
| 490867 | 2/1953 | Canada | 446/475 |
| 2577901 | 8/1986 | France | 229/109 |
| 680779 | 1/1965 | Italy | 229/109 |

*Primary Examiner*—Robert A. Hafer
*Assistant Examiner*—D. Neal Muir
*Attorney, Agent, or Firm*—Knobbe, Martens, Olson & Bear

[57] ABSTRACT

A collapsible piñata having a pair of planar main panels joined by connecting side panels. The side panels are configured to fold inward between the main panels to allow the piñata to be collapsed substantially flat. In an expanded state, the side panels extend generally perpendicularly between the spaced main panels. Reinforcing flaps are provided to brace the piñata in the expanded state. The reinforcing flaps are hingedly attached to one of the main panels and are pulled outward with strings to lie against the inner surface of the side panels. The collapsible piñata is constructed of a single piece of cardboard.

23 Claims, 8 Drawing Sheets

COLLAPSIBLE PINATA

FIELD OF THE INVENTION

This invention relates generally to an amusement device, and more particularly to a collapsible piñata.

BACKGROUND OF THE INVENTION

Piñatas have for many years found favor for use at parties and numerous other festive occasions, especially those attended by children. Piñata-breaking celebrations are quite popular in Mexico and in the Mexican-American communities of the Southwestern United States. Piñatas are traditionally a pot or container ornamented with colorful paper and filled with candy, nuts, confetti, and/or token gifts such as small toys and the like. The container is suspended from above and the children, while blindfolded, take turns attempting to puncture the container with a bat or other implement to release the treats within. The traditional pi ñata is made of clay pottery. More recently, piñatas are constructed of paper maché or other frangible material and generally include a bottom paper closure which is torn or broken by the child pulling a cord or similar attachment secured to the closure, or otherwise breaking the closure.

Typical mass-produced piñatas are constructed of paper maché and assume their full form prior to shipping. The pi ñata may be filled with treats, but are more commonly sold empty. The hollow paper maché construction of the piñata is relatively fragile and susceptible to breakage during shipping and handling.

Several attempts have been made to construct collapsible piñatas which can be reused. U.S. Pat. No. 3,702,675, issued to Bajo, discloses a piñata having a pair of flexible lateral panels and front and rear accordion pleated panels extending between the lateral panels. An expandable wire frame is mounted within the enclosed space defined by the panels for expanding or collapsing the piñata for use or storage. U.S. Pat. No. 4,253,266 discloses a collapsible and reusable pi ñata constructed of telescoping upper and lower cylinders. When the upper cylinder is suspended, the lower cylinder extends downward to the fully opened position of the pi ñata. Both these patents to Bajo suffer the disadvantage that they remain relatively fragile during shipping. Furthermore, these devices require wire frames or flexible members within the outer enclosure of the piñata, thus adding cost.

There is a need for an inexpensive piñata which is durable in shipping.

SUMMARY OF THE INVENTION

The present invention comprises a frame for a collapsible piñata, comprising a first main panel, a second main panel similar in shape to the first main panel and a plurality of connecting panels joining the main panels at peripheral edges. The first and second main panels are disposed parallel to one another and the connecting panels include a central hinge line for folding the connecting panels between the main panels. The frame is convertible from a flat configuration, in which the main panels are closely spaced with said connecting panels folded therebetween, and an expanded state in which the connecting panels are unfolded and a volume is formed between the main panels and the connecting panels. The piñata frame may include a plurality of reinforcing flaps attached to one of the main panels adapted to pivot outward from a position adjacent a main panel into a perpendicular orientation with respect to the main panels upon expanding the frame. The flaps brace the connecting panel so that the piñata is in a fully expanded condition. In one particular embodiment, the connecting panels comprise two sections, each having a short edge parallel to a longer edge, with the sections being joined at their shorter edges to form a hinge line. The sections are desirably the shape of a trapezoid.

Desirably, one of the connecting panels forms a bridge panel integral with both of the main panels. One or more of the connecting panels are formed by a section which is integral with the first main panel and extends to the other of the main panels. The connecting panel is further formed by a leaf which is integral with the other of the main panels and overlaps a portion of the panel section. A reinforcing flap may be hingedly connected to a free end of one or more of the panel sections in the first main panel. The reinforcing flaps can be extended through slots formed along a hinge line between the corresponding leaf and the other of the main panels so that the flaps extending within the volume of the piñata frame. The flaps may be drawn into a perpendicular position with respect to the main panels and parallel to and adjacent the connecting panel with which the flap is associated so as to reinforce the connecting panel. Preferably, a string is attached to a free end of one of the reinforcing flaps, the string extending through a hole in the associated connecting panel to permit the string to be pulled to draw the flap into the perpendicular position with respect to the main panel during assembly of the frame. A tab may be formed on a free end of each of the flaps, the tab being positioned within a slot formed in the first main panel approximate a hinge line between the panel section and the first main panel.

In another aspect of the present invention, a blank for constructing a piñata frame is disclosed. The blank comprises a first main panel having a polygonal shape with a plurality of straight edges, a second main panel having a polygonal shape similar to the first main panel, a bridge panel pivotally attached to adjacent parallel straight edges of the main panels, a plurality of side panels extending from some of the straight edges of the first main panel, and a plurality of leads extending from the straight edges of the second main panel. The bridge panel has a hinge line intermediate the first and second main panels and parallel to the adjacent straight edges. The side panels are pivotally coupled to the first main panel at the straight edges, each of the side panels includes a hinge line approximately midway between the adjoining straight edge of the first main panel and an outer free edge of the side panel. The hinge lines on the side panels are shorter than the adjoining straight edges of the first main panel. The leaves had a long edge coincident with the adjoining straight edge of the second main panel, and an outer free edge shorter than the long edge. Preferably, each of the side panels is formed of two trapezoidal sections having long edges and short edges parallel to the long edges, the short edges being joined at a generally central hinge line. Also, the leaves are perfectly formed as trapezoids with the long edge coincident with the adjoining straight edge of the second main panel, and the short edge disposed parallel to the long edge and forming a free edge of the leaf.

In another aspect of the present invention, a method of assembly of a piñata frame comprises the steps of: forming a blank comprising a first main panel, a second main panel, and a bridge panel joining the main panels; folding the bridge panel so that the main panels are parallel and spaced approximately the length of the bridge panel; folding a plurality of side panels on the periphery of the first main panel toward the second main panel, and folding a plurality of leaves on the periphery of the second main panel toward the first main panel so that the leaves and the side panels are juxtaposed and so that a volume is formed within the main panels and the side panels; securing the side panels and the leaves together; and collapsing the piñata frame so that the side panels and the leaves extend in between the closely adjacent main panels, so that the frame is substantially flat. The side panels and the leaves may be stapled together.

The preferred method may comprise the step of inserting a reinforcing flap hingedly connected to a free end of one or more of the side panels into slots formed in the corresponding leaf so that the flaps extend generally parallel to the main panels within the volume. The reinforcing flap may be drawn into a perpendicular position with respect to the main panels and parallel to and adjacent the side panel to which it is connected so as to reinforce the side panel. A locking tab formed in the reinforcing flap may be inserted into a locking slot formed in the first main panel to further bolster the side panel. After forming the frame, it may be suspended and rotated about a central axis and dressed with a decorative covering.

DESCRIPTION OF THE PREFERRED EMBODIMENTS

Figure 1:
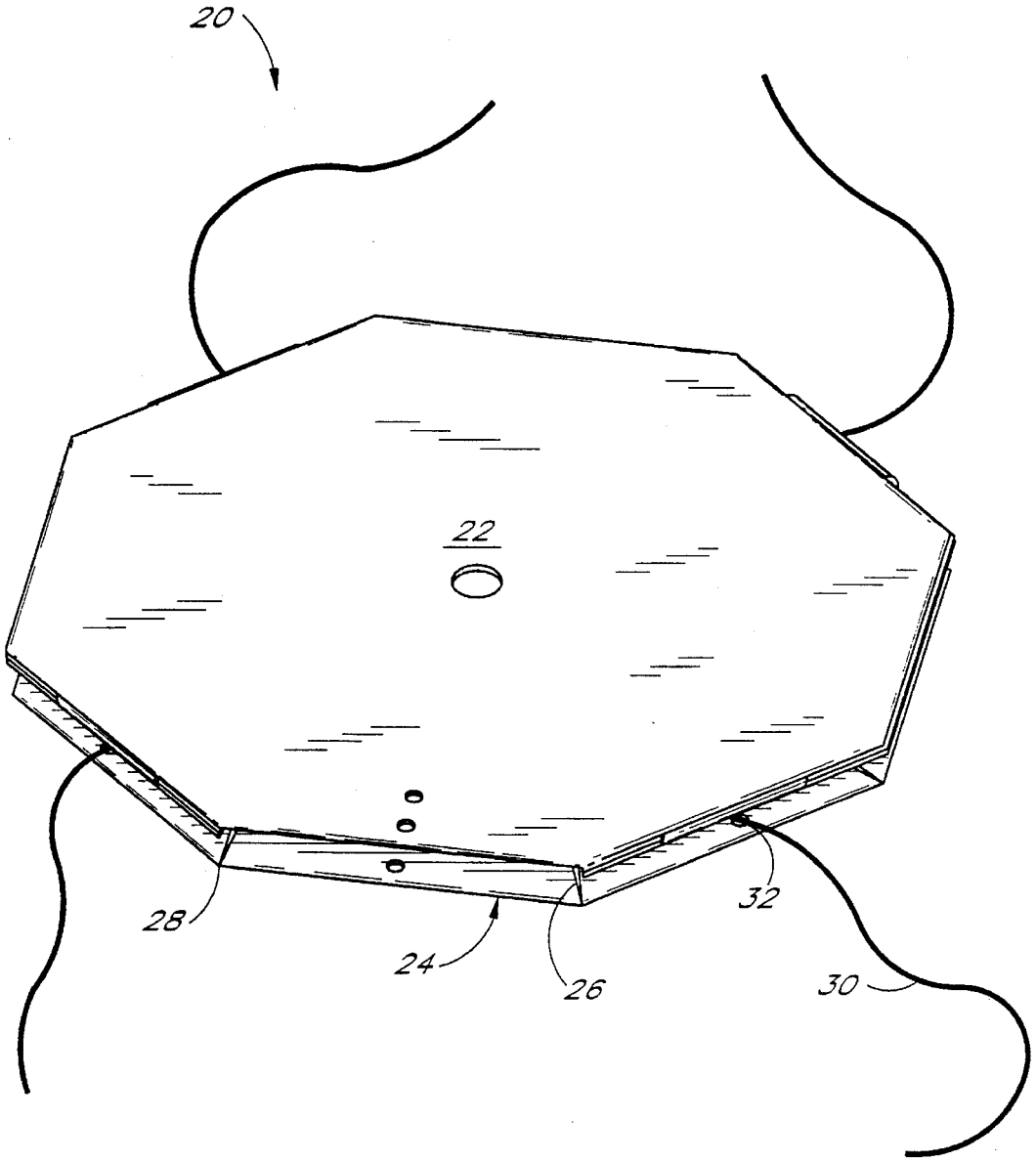
FIG. 1 is a perspective view of a piñata frame of the present invention in a collapsed state.

A piñata frame 20 of the present invention is illustrated in a collapsed state in FIG. 1. The frame 20 generally comprises a top main panel 22, a bottom main panel 24, and a plurality of connecting panels 26. For the present discussion, the top panel 22 and bottom panel 24 are oriented with respect to the perspective drawings of FIGS. 1 and 2. However, in the fully assembled form, the piñata of the present invention will be suspended so that the top and bottom panels 22, 24 are disposed vertically, thus forming side walls of the piñata. The connecting panels 26 join the top and bottom panels 22, 24 at peripheral portions thereof. In the illustrated embodiment, both the top panel and the bottom panel have an outer octagonal border so that there are eight distinct connecting panels 26 separated at corners 28. The piñata frame 20 further comprises a plurality of pull strings 30 extending into an inner cavity through apertures 32, whose purpose will be described below.

Figure 2:
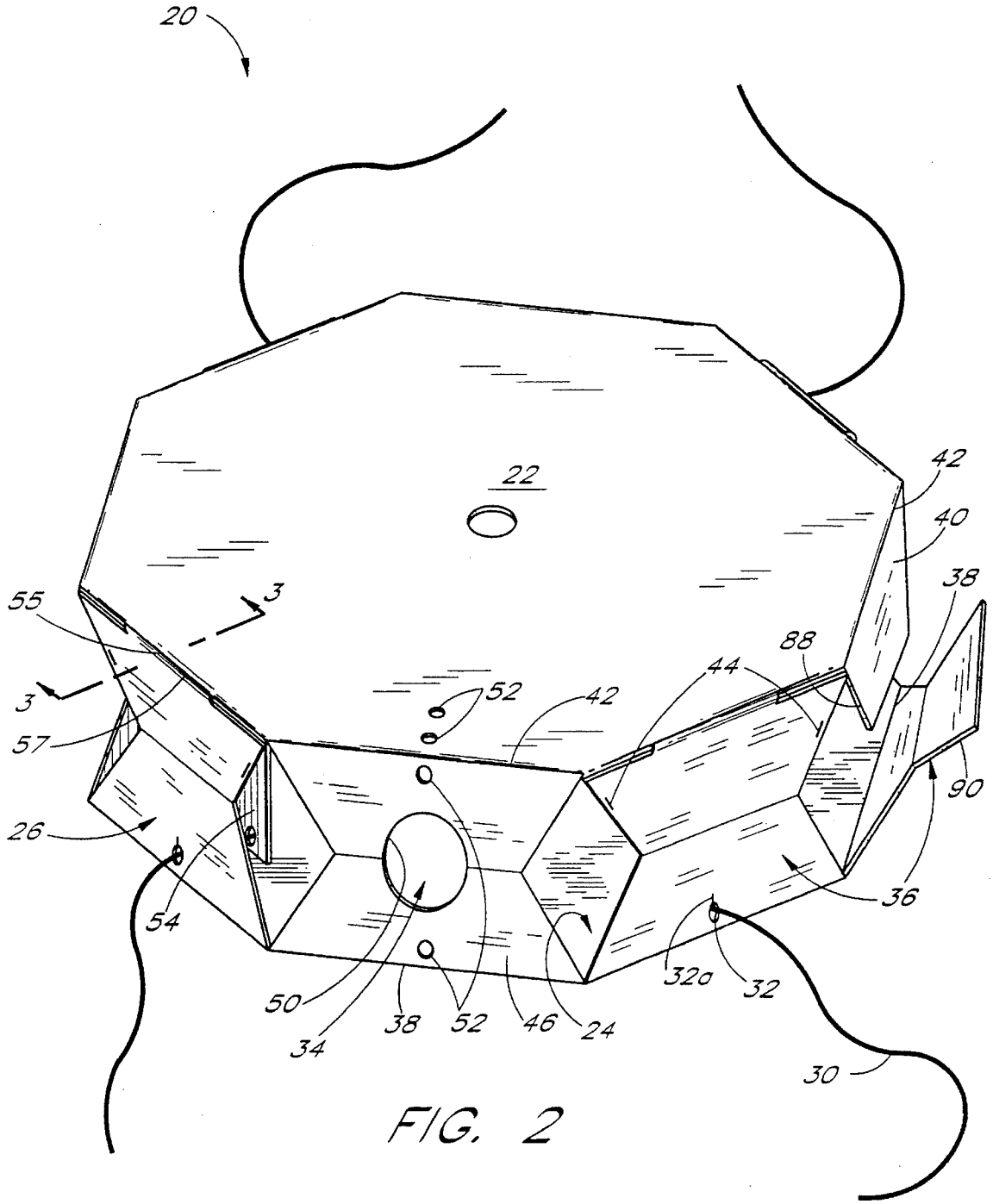
FIG. 2 is a perspective view of the piñata frame of FIG. 1 in a partially expanded state.

FIG. 2 illustrates the piñata frame 20 in an expanded state, with the top panel 22 spaced from the bottom panel 24. The top and bottom panels 22, 24 and the surrounding connecting panels 26 together define an inner cavity 34 within the piñata frame 20. As will be explained more fully below, in the expanded state the connecting panels 26 assume perpendicular orientations with respect to the top and bottom panels 22, 24. Thus, the volume of the inner cavity 34 is defined by the spacing between the top and bottom panels 22, 24 and the area of the top or bottom panels. FIG. 2 illustrates the collapsible piñata 20 in a partially expanded state before reinforcing flaps have been fully assembled.

The illustrated embodiment shows the top and bottom panels formed as octagons, but various other shapes can be utilized. In accordance with the invention, the piñata frame 20 can be converted from the collapsed flat state of FIG. 1 to an expanded state with an inner cavity 34 formed therewithin. Furthermore, although the top and bottom panels 22, 24 are illustrated with the same shape and size, it will be understood that one of the panels may be made smaller than the other or constructed with a different perimeter shape, while still embodying the inventive features herein.

In the preferred embodiment, the piñata frame 20 is constructed from a sheet of corrugated paper or cardboard, or other similar expedient. The qualities of the particular sheet material necessary for the present invention are that the material be lightweight, easy to form, easy to bend, and somewhat stiff in order to form the outer walls of the frame. Preferably, the cardboard utilized is approximately ⅛ inch thick so as to be easy to puncture by children hitting the piñata 20 with a bat or other such implement. One particularly desirable material is a cardboard with a designation 150 lb. B flute. Of course, the cardboard frame 20 may be covered or "dressed" with an ornamental paper, such as paper maché, or other such design so as to conceal the frame within. The colorful paper is preferably adhered to the flat top and bottom panels 22, 24 and to the connecting panels 26. Care must be taken to leave loose paper in the areas of the bends between the connecting panels 26 and the top and bottom panels 22, 24 to allow the piñata to be expanded without damaging the decorative covering.

With reference again to FIG. 2, and more particularly to the right side thereof, a side panel 36 is illustrated bent away from the remainder of the frame 20. Each of the side panels 36 is attached to the bottom panel 24 along hinges 38. In the illustrated embodiment, there are eight such side panels 36. Eight leaves 40 depend downward from the top panel 22 at hinges 42. The hinges 38 and 42 are preferably simple bends in the frame material. Leaves 40 are positioned so as to be juxtaposed with and contact an inner surface of the side panels 36. The side panels 36 and leaves 40 are attached along lateral edges using staples 44 to define the connecting panels 26. Alternatively, tape, glue, or other similar expedient may be substituted for the staples 44.

One of the eight side panels 36 comprises a bridge panel 46 which is connected at a lower hinge 38 to the bottom panel 24 and also connected at an upper hinge 42 to the top panel 22. A large, generally circular access port 50 is formed in the bridge panel 46. When the piñata frame 20 is expanded, as seen in FIG. 2, the access port allows candy and other treats to be inserted into the inner cavity 34. Of course, a similarly shaped port will be formed in the outer colorful paper wrapping for this purpose. A plurality of suspension apertures 52 are formed on either side of the access port 50 and in the top panel 22, the apertures providing points at which suspension strings (not shown) can be attached for hanging the piñata.

Figure 3:
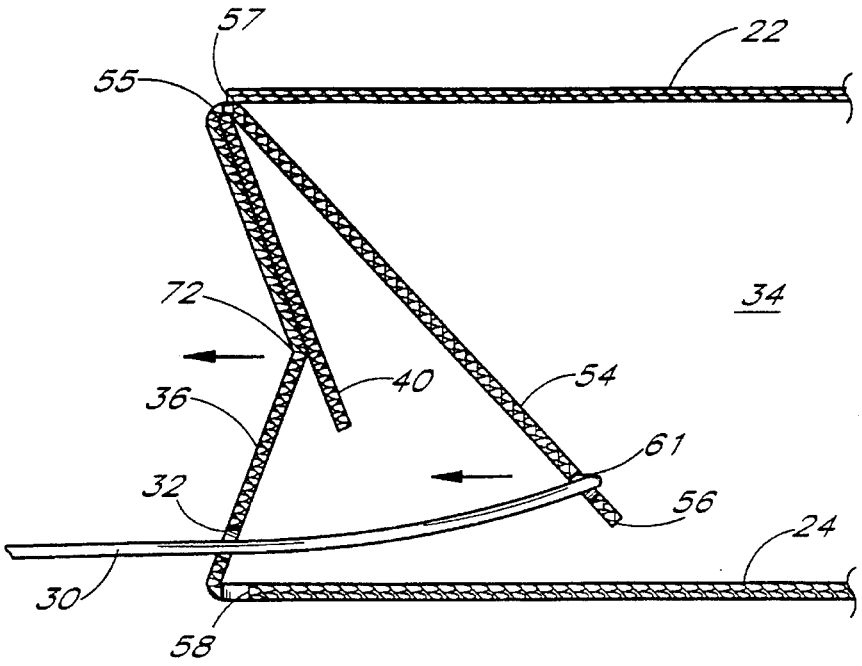
FIG. 3 is a cross-sectional view of one side panel of the piñata of FIG. 2 prior to being fully expanded.
Figure 4:
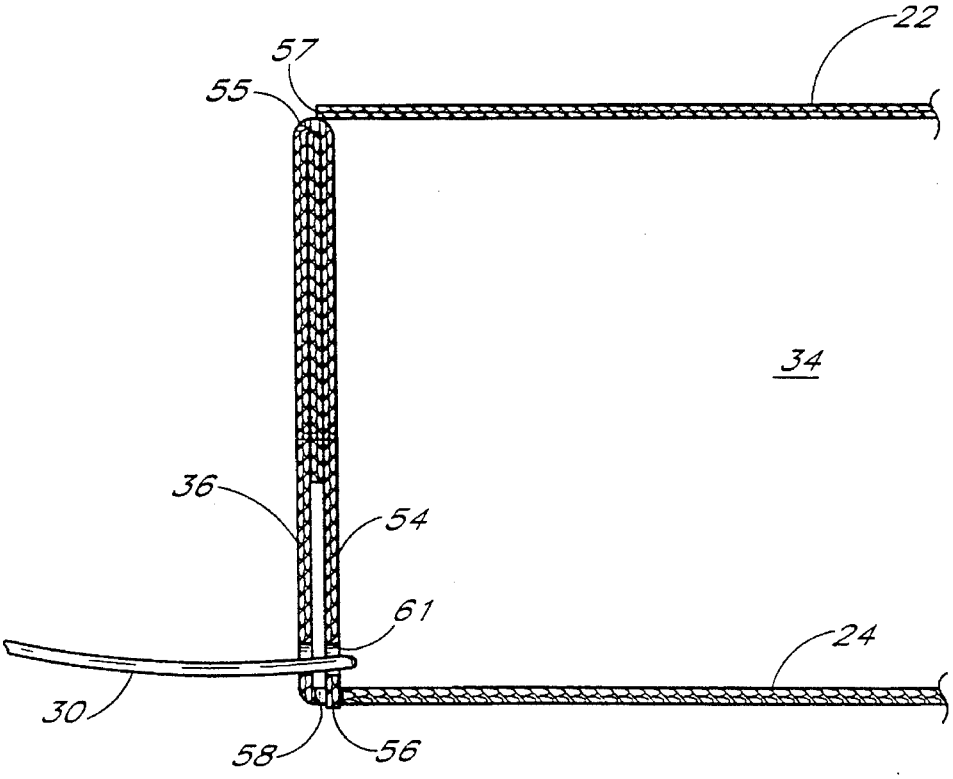
FIG. 4 is a cross-sectional view similar to FIG. 3 after a reinforcing flap has been pivoted outward to fully expand the piñata.

Now with reference to FIGS. 2–4, an apparatus for expanding the piñata frame 20 into its final form, wherein the connecting panels 26 are reinforced, is described. As seen in the inner cavity 34 of the frame 20 in FIG. 2, a reinforcing flap 54 is attached to one of the pull strings 30. The reinforcing flap 54 is attached to outer edges of the bottom panel 24 and, more specifically, is hinged at 55 to the free end of one of the side panels 36. This pivot axis is illustrated most clearly in FIG. 3. A small locking tab 56 is formed on a free end of the reinforcing flap 54. The flap 54 extends through an elongated slot 57 formed in one of the leaves 40. The slot 57 is formed in the leaf 40 adjacent the hinge 42 between the leaf and the top panel 22. There are four such reinforcing flaps 54 extending from the side panels 36 pivotably attached to the bottom panel 24. Also, there are four elongated slots 57 formed in the four leaves 40 corresponding to the positions of the four flaps 54.

As seen best in FIG. 3, the side panel 36 thus extends upward adjacent the leaf 40 with the reinforcing flap 54 extending into the cavity 34 of the frame 20. The flap 54 extends inward into the cavity 34 generally parallel to and underneath the top panel 22, although the flap is shown in a partially pivoted state in FIG. 3. The pull string 30 is attached at eyeholes 61 proximate a free end of the reinforcing flap 54 and extends outward through the aperture 32. Thus, by pulling outward on the string 30, the flap 54 is pivoted downward from below the plane of the top panel 22 and outward toward the associated side panel 36. The apertures 32 have small slits **32*a*** extending therefrom for use in an assembly process, as will be described below.

Ultimately, by pulling the string 30, the reinforcing flap 54 is juxtaposed with the leaf 40 and side panel 36, the three elements being disposed generally vertically and perpendicular to both the top panel 22 and bottom panel 24, as seen in FIG. 4. The locking tab 56 on the free end of the reinforcing flap 54 projects within a locking slot 58 formed proximate the perimeter of the bottom panel 24. In this position, the reinforcing flap 54 holds the shape of the piñata frame 20. FIG. 3 illustrates the slight extension of the leaf 40 past the hinge line 72 in the side panel 36. This further braces the side panel 36 from folding inward when the reinforcing flap 54 is fully installed with the locking tab 56 within the slot 58.

Figure 5:
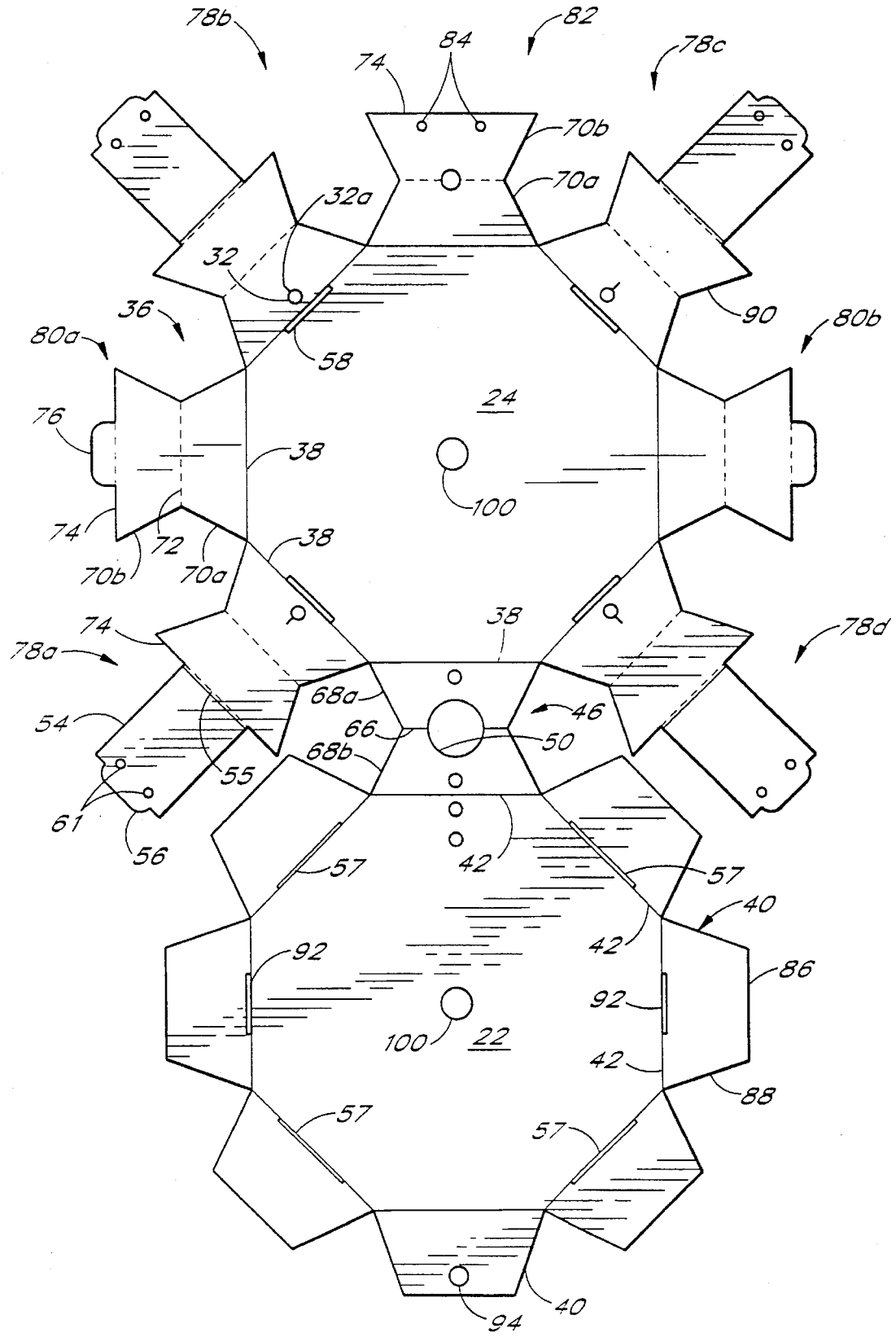
FIG. 5 is a plan view of the piñata of FIG. 1 after being unfolded and showing a preferred construction shape.

A preferred one-piece construction of the piñata frame 20 is illustrated in FIG. 5. In this view, the various panels and flaps have been folded out to show the plan view thereof. Thus, it can be readily seen that the top panel 22 is joined to the bottom panel 24 at the bridge panel 46. As mentioned previously, the bridge panel 46 attaches to the bottom panel 24 at a hinge 38 and to the top panel 22 at a hinge 42. A central hinge 66 allows the bridge panel 46 to fold inwardly between the top and bottom panels 22, 24 in the collapsed state of the frame 20. The bridge panel 46 is thus divided into two adjoining sections **68*a* and 68*b*. The sections 68*a,b* are pivotably attached together at the hinge 66 and are pivotably attached to the bottom and top panels 24, 22, respectively, at hinges 38 and 42. Sections 68*a,b* may be formed as trapezoids, with long sides at the hinges 38, 42 and short sides along the common hinge 66**.

The side panels 36 also comprise a first section **70*a* adjacent the bottom panel 24 and the second section 70*b* each having a short edge parallel to a longer edge, with the sections being joined at their shorter edges to form a weakened hinge line 72. Each of the side panels 36 hingedly attaches at one of the eight sides of the bottom panel 24 along the hinges 38. The weakened hinge line 72 is preferably formed by scoring the exterior surface of the hinge so that the side panels 36 will more readily bend inward into the cavity 34 for collapsing the frame 20. Other configurations in which the hinge lines 72 are weakened on the exterior side to allow this preferred folding are contemplated. An outer free edge 74 includes a central rounded tab 76**, whose purpose will be described below.

In a preferred form, the sections **70*a*, 70*b* have the shape of a trapezoid and include angled lateral edges 90. The angled edges 90 on the inner trapezoidal section 70*a* extend between the hinge 38 and hinge line 72, while the angled edges on the outer trapezoidal section 70*b* extend between the hinge line 72 and the free edge 74. The particular angle of the edges 90 is determined by the number of sides of the polygonal bottom panel 24. In the illustrated embodiment, the bottom panel 24 is an octagon, with eight sides, and the angle between one of the angled edges 90 and the line along the hinge 38 is not greater than 67.5 degrees. This allows the first trapezoidal section 70*a* of each side panel 36 to be folded inward into the cavity 34 when collapsing the frame 20 so that the angled edges 90 do not interfere with the angled edges of adjacent side panels 36. Most desirably, the angle of the edges 90 is 67.5° so that, when the first trapezoidal section 70*a* is folded inward against the bottom panel 24, the angled edges extend from the hinge 38 toward the center of the bottom panel. Of course, the angle between the edge 90 and the hinge 38 could be made smaller so that a gap exists between adjacent edges of adjoining side panels 36 when folded inward into the cavity 34. However, the angle is preferably maximized so that the hinge line 72 has a maximum length possible for strength purposes, while still precluding interference between adjacent edges 90 when collapsing the frame 20**.

Other frame configurations may have a different number of sides, with the top and bottom panels 22, 24 respectively form as various polygons. The angle formed between the edge 90 and the hinge 38 depends on the number of sides of the particular polygon. More specifically, the inner trapezoidal section **70*a* has side edges 90 which make an angle with the hinge 38** of no more than:

90°, * {1.0–{2.0/the # of sides of the polygon)}. For example, a square frame 20, with four sides, would dictate that the first trapezoidal section 78 have angled edges 90 forming at most a 45° angle with the hinge 38. As the number of sides increases, the maximum angle between the angled edge 90 and the hinge 38 likewise increases. Thus, a decahedron-shaped frame 20, with ten sides, would dictate the angled edge 90 make an angle of 72° with the hinge 38.

Additionally, the spacing between the top and bottom panels 22, 24 may be adjusted to form larger or smaller piñata frames. In the illustrated embodiment, the perpendicular distance between the hinge 38 and hinge line 72 is less than the length of either of the hinges. Of course, this distance can be increased to form a larger volume within the assembled frame 20. As this distance is increased, however, the length of the hinge line 72 decreases due to the converging angled sides 90. Thus, there is a practical minimum at which the hinge line 72 will be unduly weak, and a corresponding maximum to the spacing between the top and bottom panels 22, 24.

As mentioned above, the bottom panel 24 is formed as an octagon with eight straight sides forming the eight hinges 38 joining to the side panels 36. Although there are eight such sides panels 36 around the periphery of the bottom panel 24, several varying configurations are provided. Looking clockwise from the lower bridge panel 46, a first type of side panel 78*a* includes the adjoining trapezoidal sections 70*a, b* hingedly attached to the bottom panel 24 at the hinge 38, in addition to the reinforcing flap 54 pivotably attached to the free edge 74 at the hinge 55. At locations spaced around the bottom panel 24 at 90°, 180° and 270° from the side panel 78*a*, three other first type of side panels 78*b*, 78*c*, and 78*d*, respectively, are provided. At a 45° clockwise position from the side panel 78*a*, a second type 80*a* of side panel is shown. The second type of side panel 80*a* comprises the adjoining trapezoidal sections 70*a, b* attached to the bottom panel 24 at hinge 38, and the previously described rounded tab 76 pivotably attached at the free end 74. Another second type of side panel 80*b* is provided 180° opposite from the side panel 80*a*. Finally, a third type of side panel 82 is provided 180° opposite from the bridge panel 46. This side panel 82 comprises the adjoining trapezoidal sections 70*a, b* terminating in the free edge 74. A pair of release string securement apertures 84 are formed in the outer trapezoidal section 70*b* adjacent to the free edge 74. The purpose of the apertures 84 will become clear below.

Now referring to the lower portion of FIG. 5, the top panel 22 is surrounded by eight hinges 42 on its eight sides. The bridge panel 46 pivotably attaches to the top panel 22 at one of the hinges 42. At the remaining seven hinges 42, seven leaves 40 are pivotably attached. The leaves 40 comprise trapezoidal shapes with a long edge at the hinge 42 and a shorter free edge 86. The lateral edges 88 are angled so as to be collinear with the angled edges 90 formed on the outer trapezoidal section 70*b* of the side panels 36 when the piñata frame 20 is assembled, as can be seen in FIG. 2. The elongated slots 57 are formed adjacent the hinges 42 in four of the leaves 40 disposed at clockwise angles of 45°, 135°, 225° and 315°, respectively, from the bridge panel 46. As described above, the elongated slots 57 receive the reinforcing flaps 54 extending from the first type side panels 78*a–d* attached to the bottom panel 24. Two smaller slots 92 are formed adjacent the hinges in leaves 40 at 90° and 270° clockwise angles from the hinge panel 46 for receiving the rounded tabs 76 extended from the second type of side panel 80*a,b*. The slots 57 and 92 are formed in the leaves 40 so that the respective insertion members extend radially inward into the cavity 34, rather than down through the top panel 22. Thus, the slots 57 and 92 are formed to the outside of the hinges 42.

Finally, leaf 40 directly opposite the bridge panel 46 includes a single pull string aperture 94. The leaf 40 with the pull string aperture 94 cooperates with the side panel 82 to form a trap door in the assembled piñata. More particularly, the side panel 82 and flap 40 are not stapled together in the final assembled piñata, but rather are simply covered by the decorative outer dressing. A plurality of pull strings (not shown) depend from the lower edge of the piñata, only one of which is secured to the apertures 84 and 94. The pull strings extend through the colorful paper exterior of the piñata downward into the reach of smaller children. Rather than whacking the side of the piñata with a bat, or other similar expedient, the children pull one of the strings depending from the piñata. When the string that is attached to the apertures 84, 94 is pulled, the trap door panel rips open through the frangible paper exterior of the piñata, spilling the candy and treats onto the ground for the small children.

A pair of center holes 100 are formed in the top and bottom panels 22 and 24.

Figure 6:
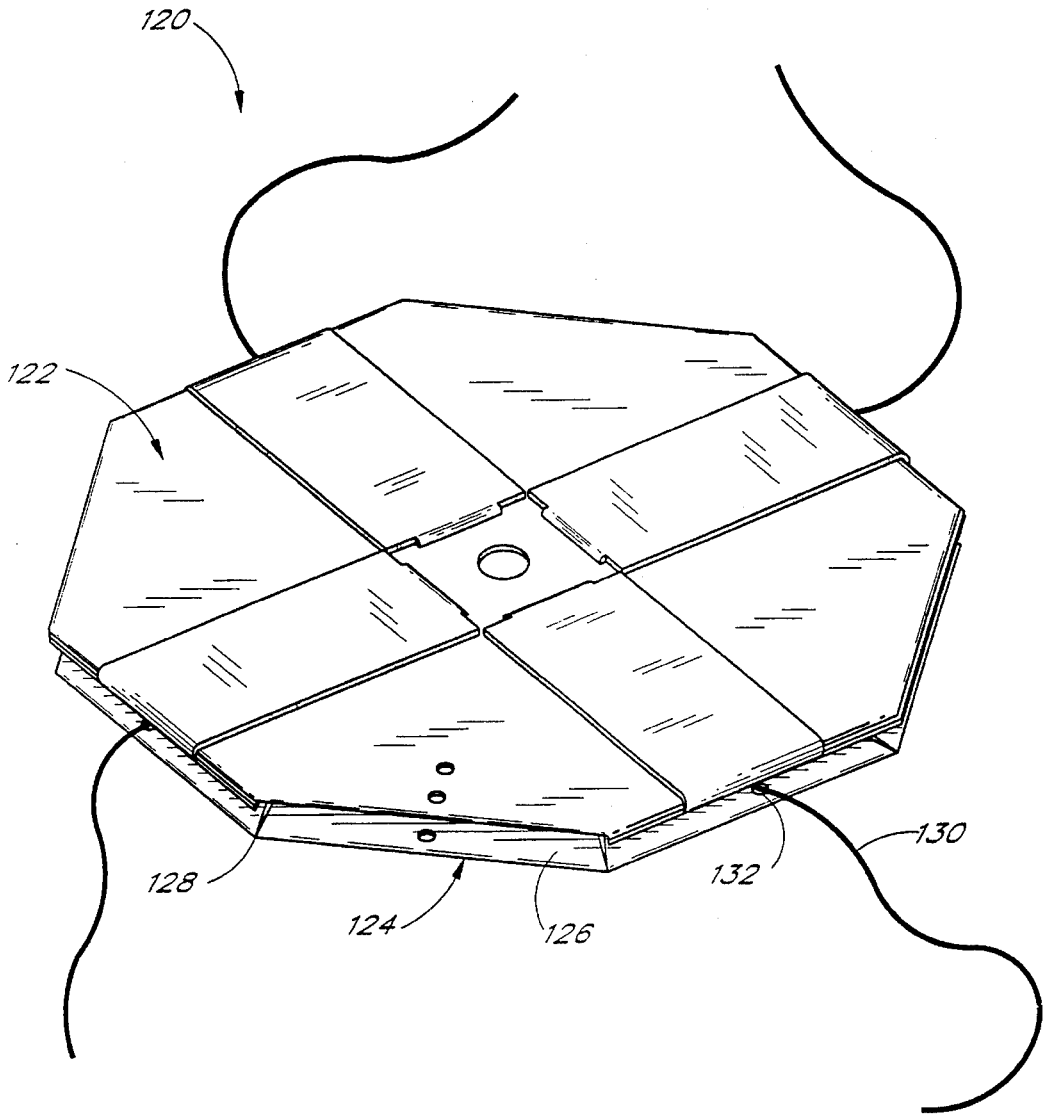
FIG. 6 is a perspective view of an alternative piñata frame of the present invention in a collapsed state.

An alternative piñata frame 120 of the present invention is illustrated in a collapsed state in FIG. 6. The frame 120 generally comprises a top panel 122, a bottom panel 124, and a plurality of connecting panels 126. The connecting panels 126 join the top and bottom panels 122, 124 at peripheral portions thereof. In the illustrated embodiment, both the top panel and the bottom panel have an outer octagonal border so that there are eight distinct connecting panels 126 separated at corners 128. The piñata frame 120 further comprises a plurality of pull strings 130 extending into an inner cavity through apertures 132, whose purpose will be described below.

Figure 7:
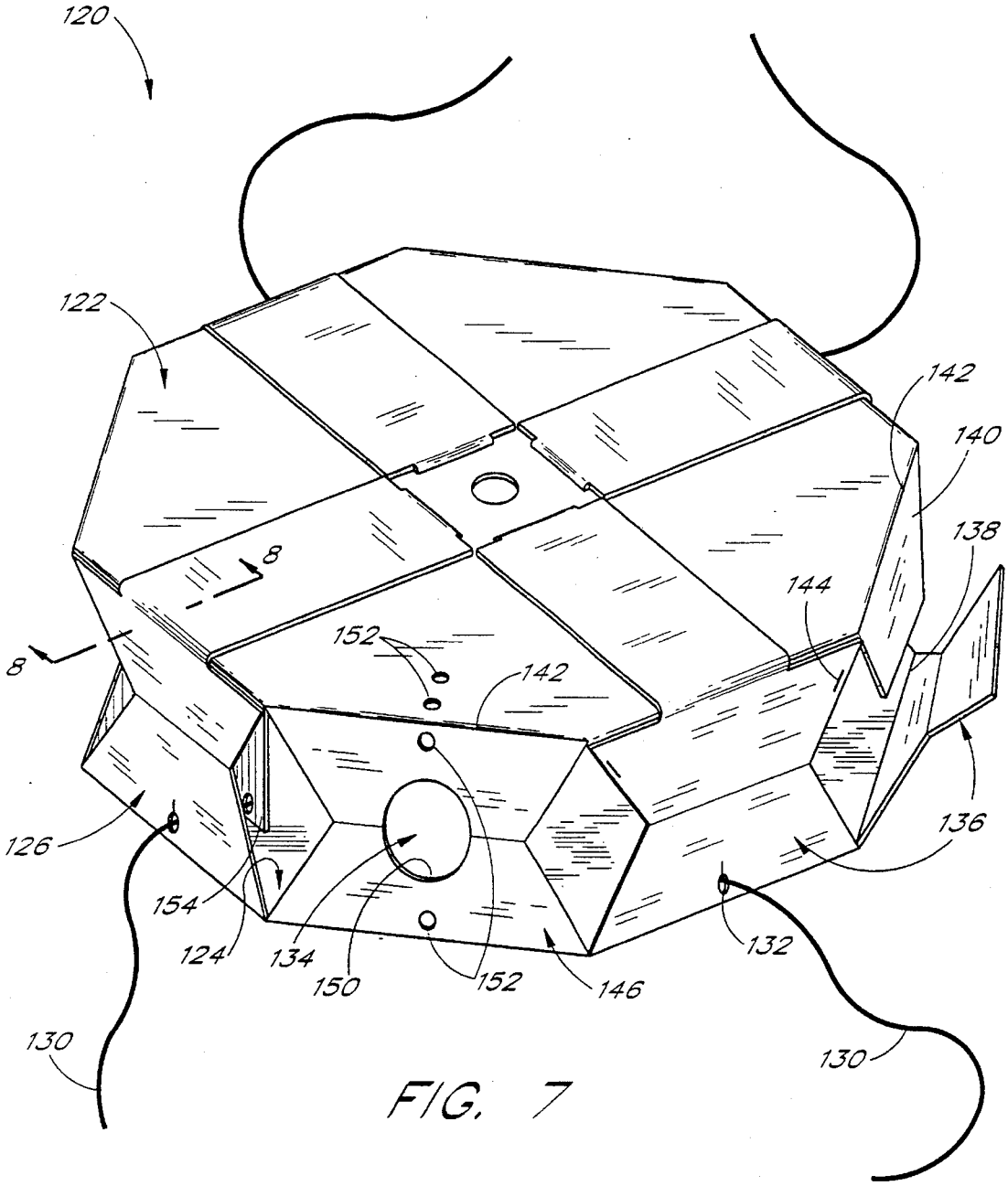
FIG. 7 is a perspective view of the piñata frame of FIG. 6 in a partially expanded state.

FIG. 7 illustrates the piñata frame 120 in a partially expanded state, with the top panel 122 spaced from the bottom panel 124. The top and bottom panels 122, 124 and the surrounding connecting panels 126 together define an inner cavity 134 within the piñata frame 120. As will be explained more fully below, in the expanded state shown in FIG. 7, the connecting panels 126 assume perpendicular orientations with respect to the top and bottom panels 122, 124. Thus, the volume of the inner cavity 134 is defined by the spacing between the top and bottom panels 122,124 and the total area defined by the top and bottom panels.

As in the embodiment of FIG. 1, the piñata frame 120 is constructed from a frangible corrugated paper or cardboard, or other similar expedient. Also, the frame 120 will be covered by an ornamental paper or other such design so as to conceal the frame within. The colorful paper is preferably adhered to the flat top and bottom panels 122,124 and to the connecting panels 126. Care must be taken to leave some loose paper in the areas of the bends between the connecting panels 126 and the top and bottom panels 122,124.

With reference again to FIG. 7, and more particularly to the right side thereof, a side panel 136 is illustrated bent away from the remainder of the frame 120. Each of the side panels 136 is attached to the bottom panel 124 along hinges 138. In the illustrated embodiment, there are eight such side panels 136. Eight leaves 140 depend downward from the top panel 122 at hinges 142. Leaves 140 are positioned so as to contact an inner surface of the side panels 136. The side panels 136 and leaves 140 are attached along lateral edges using staples 144. Alternatively, tape, glue, or other similar expedient may be substituted for the staples 144.

One of the side panels 136 comprises a bridge panel 146 which is connected at a lower hinge 138 to the bottom panel 124 and also connected at an upper hinge 142 to the top panel 122. A large, generally circular access port 150 is formed in the bridge panel 146. When the piñata frame 120 is expanded, as seen in FIG. 7, the access port allows candy and other treats to be inserted into the inner cavity 134. Of course, a similarly shaped port will be formed in the outer colorful paper wrapping for this purpose. A pair of suspension apertures 152 and 154 are formed on either side of the access port 150 and in the top panel 122, the apertures providing points at which suspension strings (not shown) can be attached for hanging the piñata.

Figure 8:
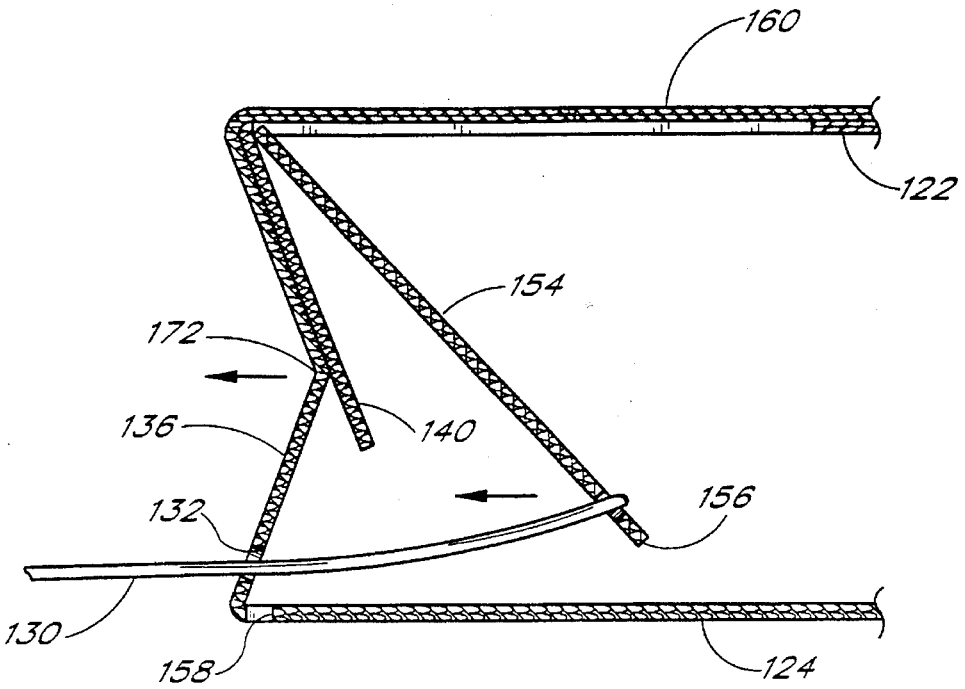
FIG. 8 is a cross-sectional view of one side panel of the piñata of FIG. 7 prior to being fully expanded.
Figure 9:
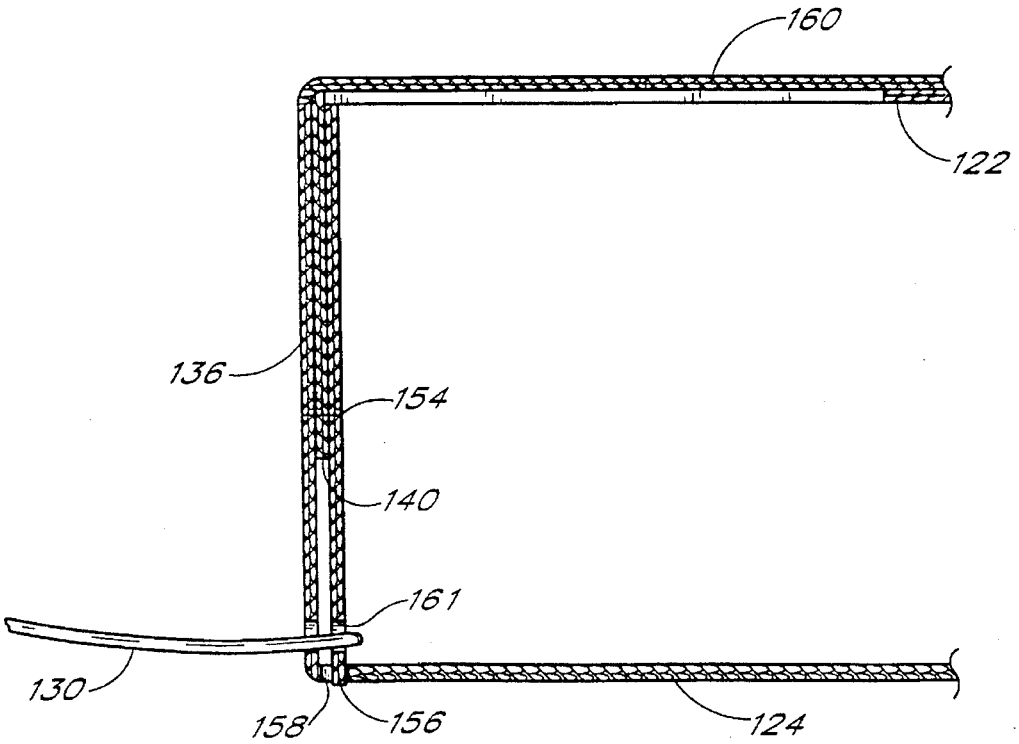
FIG. 9 is a cross-sectional view similar to FIG. 8 after a reinforcing flap has been pivoted outward to fully expand the piñata.

Now with reference to FIGS. 7–9, a method for expanding the piñata frame 120 into its final form, wherein the connecting panels 126 are reinforced, is described. As seen in the inner cavity 134 of the frame 120 in FIG. 7, a reinforcing flap 154 is attached to one of the pull strings 130. The reinforcing flap 154 is cut from the top panel 122 and is hinged approximately along the line between one of the side panels 136 and one of the eight sides of the top panel. This pivot point is illustrated most clearly in FIG. 3. The pull string 130 extends outward through the aperture 132 and is attached proximate a free end of the reinforcing flap 154. Thus, by pulling on the string 130, the flap 154 is pivoted downward from the plane of the top panel 122 and outward toward the associated side panel 136. Ultimately, the reinforcing flap 154 is juxtaposed with the leaf 140 and side panel 136, the three elements being disposed generally vertically and perpendicular to both the top panel 122 and bottom panel 124, as seen in FIG. 9. A small tab 156 on the free end of the reinforcing flap 154 projects within a locking slot 158 formed proximate the perimeter of the bottom panel 124. In this position, the reinforcing flap 154 holds the shape of the piñata frame 120.

As previously mentioned, the reinforcing flap 154 is cut from the top panel 122. Thus, in the collapsed state of FIG. 6, the reinforcing flap 154 lies in the same plane as the top panel 122. As the pull strings 130 are pulled outward, the pivoting of the reinforcing flap 154 exposes an elongated hole in the top panel 122. This hole is hidden by a cover flap 160 extending inward from the side panel 136 associated with the reinforcing flap 154. The cover flap 160 extends toward the center of the top panel 122 and terminates in a locking tab 162 which extends within a locking slot 164 (FIG. 10) formed in the top panel 122. In the alternative configuration, therefore, the reinforcing flaps 154 comprise a portion of the top panel 122, rather than being an extension of a bottom panel side flap, as in FIGS. 1–5.

Figure 10:
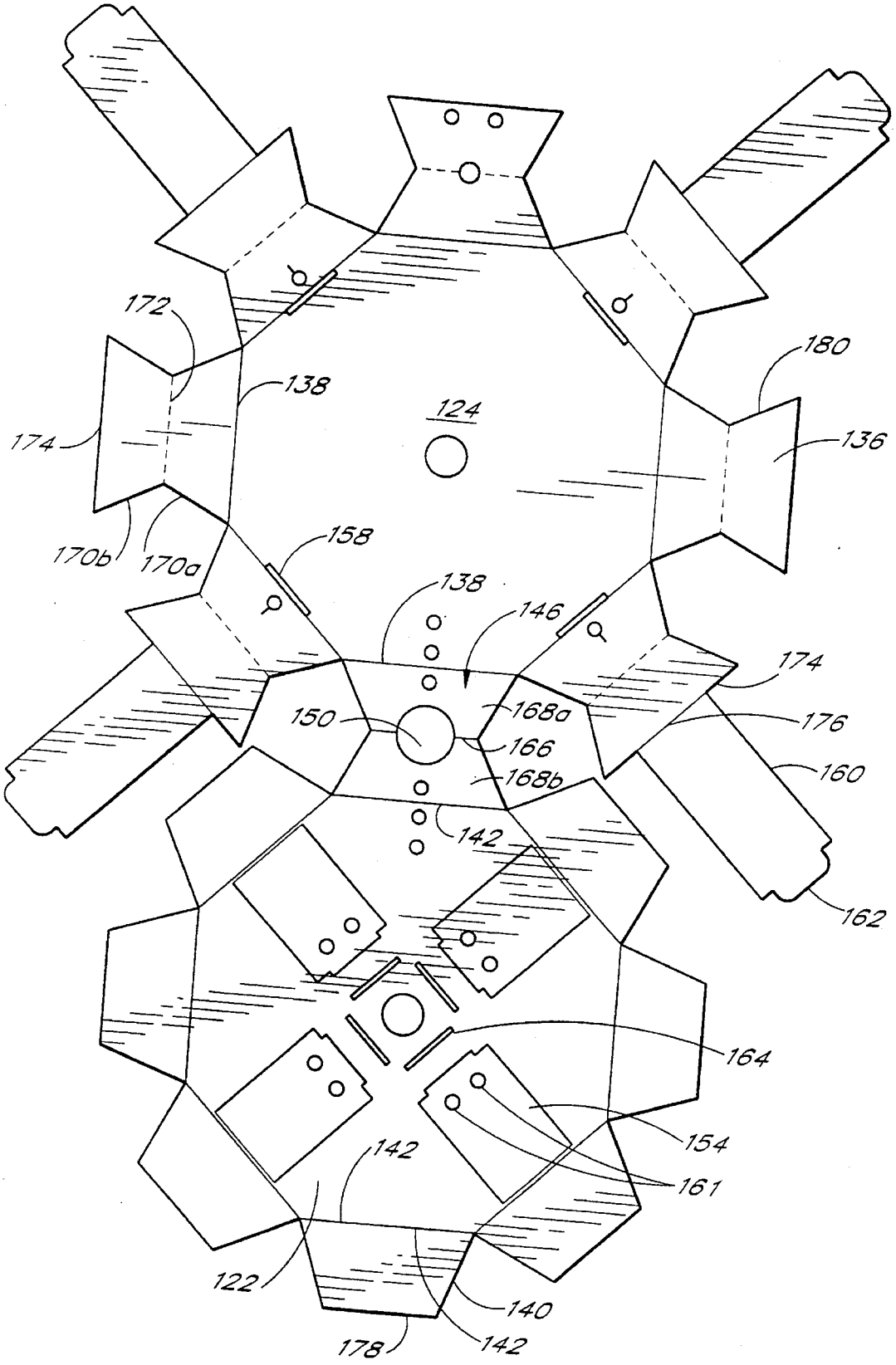
FIG. 10 is a plan view of the piñata of FIG. 6 after being unfolded and showing an alternative construction shape.

A preferred one-piece construction of the piñata frame 120 is illustrated in FIG. 10. In this view, the various panels and flaps have been folded out to show the plan view thereof. Thus, it can be readily seen that the top panel 122 is joined to the bottom panel 124 at the bridge panel 146. As mentioned previously, the bridge panel 146 attaches to the bottom panel 124 at a hinge 138 and to the top panel 122 at a hinge 142. A central hinge 166 allows the bridge panel 146 to fold inwardly between the top and bottom panels 122, 124 in the collapsed state of the frame 120. The bridge panel 146 is thus divided into two adjoining sections **168*a* and 168*b*. The sections 168*a,b* are pivotably attached together at the hinge 166 and are pivotably attached to the bottom and top panels 124, 122, respectively, at hinges 138 and 142. Sections 168*a,b* are formed as trapezoids, with long sides at the hinges 138, 140 and short sides along the common hinge 166**.

Likewise, each of the side panels 136 includes first sections **170*a* and second sections 170*b*. The sections 170*a,b* are joined at a weakened hinge 172. Each of the side panels hingedly attaches at one of the eight sides of the bottom panel 124 along the hinges 138. Three of the side panels 136 include free edges 174 opposite the hinge 138, while four of the side panels 136 include the cover flaps 160 attached at the free edge 174 along a shortened hinge line 176. The weakened hinge 172 is preferably formed by scoring the exterior surface of the hinge so that the side panels 136 will more readily bend inward into the cavity 134 for collapsing the frame 120. Other configurations in which the hinges 172 are weakened on the exterior side to allow this preferred folding are contemplated. The shape of the locking tab 162 on the cover flap 160 are seen best in FIG. 5**.

With regard to the top panel 122, seven of the eight sides exhibit the trapezoidal shaped hinged leaves 140. These leaves 140 are joined at the hinge lines 142 and have free edges 178 extending away from the top panel. The width of the leaves 140 from the hinge line 142 to the free edge 178 are greater than the width of the first section **170*a* of each of the side panels 136 from the hinges 138 to the weakened hinge 172. This is best seen in FIG. 3, wherein the leaf depends downward past the hinge 172. Thus, when the reinforcing flap 154 is seated within the locking slot 158, the leaf 140 helps brace the hinge 172** from bending inward with the assistance of the backing reinforcing flap.

The trapezoidal shapes of the side panels 136 allow the side panels to be bent inward so that their lateral edges 180 terminate in close proximity without contacting. Thus, as seen in FIG. 2, generally diamond-shaped apertures are formed by adjacent side panels 136, these apertures being closed up when the piñata frame 120 assumes the collapsed state of FIG. 1.

Manufacturing Steps

To construct the piñata of the present invention, the frame 120 is first cut from a blank of cardboard into one of the shapes shown in FIGS. 5 or 10. In the preferred embodiment, the piñata frame 20 is formed from a single piece of cardboard with the top and bottom panels 22, 24 joined by the hinge panel 46. Of course, the piñata frame 20 of the present invention can be formed of a number of pieces of cardboard joined together, with the number of assembly steps correspondingly increasing. The particular shape may be formed by a variety of methods, but a particularly desirable method is to utilize a die board.

A die board typically comprises a large substrate, such as wood, with a plurality of sharp, razor-like blades placed therein at a particular pattern. The blades can be straight or curved, depending on the pattern. The complete circles in the cardboard are formed by tubular knives having small springs disposed centrally therein to expel the round cardboard plugs formed. The various fold lines are formed by rounded blades disposed at the same height as the cutting blades. The rounded blades thus imprint a depression in the normally corrugated cardboard to create lines of weakness in bending. Cuts can be made by using blades with a series of intermittent teeth, thus creating a dashed line cut. Finally, partial cuts through the thickness of the cardboard, such as at the exterior of the hinge line 72, can be made by utilizing a blade with a series of intermittent teeth, the blade being sized shorter than the other full-cutting blades so the cardboard blank is cut only partway through.

When using a flat die, the knives are positioned pointing upward from a flat board and the cardboard blank pressed downward upon them. Typically, foam or rubber inserts are positioned adjacent the knives to facilitate release of the cut cardboard therefrom. The foam inserts have a height approximately equal to the height of the cutting knives, and the cardboard compresses the foam when pressed down upon the knives. The compressed inserts resiliently expand on release of the pressing force to push the cardboard off the knives.

In a preferred method, a rotary die board is utilized. A cylinder of wood has a plurality of knives placed in a particular pattern there around and blanks of cardboard are fed into proximity with the rotating die. As the die rotates, it cuts the particular pattern shown in FIGS. 5 or 10 from the blanks of cardboard. Again, foam inserts are placed around the knives to facilitate release of the cardboard from the knives. Although this type of die is somewhat more expensive than a plain flat die, the production rate is greatly increased. In one particular embodiment, the production rate is approximately 5,000 blanks with the shape of FIG. 5 in one hour utilizing a rotary die. Either the flat dies or the rotary dies may be obtained from Crockett Container of Los Angeles, Calif.

The center holes 100 (FIG. 5) provide a rotational mounting point for a dowel rod to facilitate covering the frame 20 with decorative material. This process is termed dressing the piñata. Glue is applied to the exterior of the fully formed frame 20 and paper or other material applied to the glue. In this manner, the piñata is suspended on the dowel rod above any surfaces which the glue might stick to and contaminate.

Assembly Steps

After cutting the form of FIG. 5, the frame 20 is assembled. First, the top and bottom panels 22, 24 are brought parallel to one another by bending about the hinges 38 and 42 surrounding the bridge panel 46. As the panels 22, 24 are brought together, the reinforcing flaps 54 are inserted through the slots 57 in the leaves 40. The rounded tab 76 are inserted into the shorter slots 92. Prior to dressing the frame 20, the pull strings 30 are attached to the eyeholes 61 in the reinforcing flaps 54, which are now within the cavity 34 of the frame 20. The pull strings 30 are inserted through the apertures 32 to the exterior of the frame 20. When a short length of each pull string 30 is exposed through the apertures 32, the pull string is secured in the slit 32*a* which will allow for proper dressing of the frame 20. More particularly, the pull strings are only extended a short distance from the aperture 32 so as to prevent glue from being applied to loosely dangling strings during a dressing process. Suspension strings (not shown) are attached to the apertures 52. The staples 44 are then applied to secure the side flaps 36 to the leaves 40 to complete the assembly of the frame 20. A dowel rod is inserted through the central through holes 100 and the piñata frame 20 dressed with a variety of decorative designs. After dressing the piñata frame 20, the pull strings 30 are fully extended through the apertures 32. At this point, the collapsible piñata can be collapsed flat, as in FIG. 1, and shipped to the retail outlet for resale or for filling with candy prior to resale.

Although this invention has been described in terms of certain preferred embodiments, other embodiments that are apparent to those of ordinary skill in the art are also within the scope of this invention. Accordingly, the scope of the invention is intended to be defined by the claims that follow.

We claim:

1. A frame for a piñata, comprising:

a first main panel;

a second main panel similar in shape to said first main panel, said second main panel being disposed parallel to said first main panel;

a plurality of connecting panels joining the main panels at bends defining peripheral edges, each of said connecting panels including a central hinge line for folding said connecting panels between said main panels, said frame being convertible from a flat configuration in which said main panels are closely spaced with said connecting panels folded therebetween and an expanded state in which said connecting panels are unfolded and a volume is formed between said main panels and said connecting panels; and a plurality of reinforcing flaps attached to said frame and adapted to pivot about some of said peripheral edges of said main panels, said flaps bracing said connecting panels upon expanding said frame into said fully expanded state.

2. The piñata frame of claim 1, wherein said plurality of reinforcing flaps are attached to said connecting panels and are adapted to pivot outward from a position adjacent one of said main panels into a perpendicular orientation with respect to and between said main panels upon expanding said frame.

3. The frame of claim 1, wherein each of said connecting panels comprises two sections each having a short edge parallel to a longer edge, with the sections being joined at their shorter edges to form said hinge line.

4. The frame of claim 3, wherein each of said sections has the shape of a trapezoid.

5. The frame of claim 4, wherein said main panels are similar shaped polygons with straight peripheral edges juxtaposed with the longer edges of an inner one of said trapezoidal sections, each of said trapezoidal sections has angled side edges connecting said long and short edges, said side edges making an angle with said long edge of no greater than the formula 90° * {1.0–{2.0/# of edges of said polygon)}.

6. The frame of claim 1, wherein one of said connecting panels forms a bridge panel which is integrally formed as one unit with said main panels.

7. A frame for a piñata, comprising:

a first main panel;

a second main panel similar in shape to said first main panel, said second main panel being disposed parallel to said first main panel;

a plurality of connecting panels joining the main panels at bends defining peripheral edges, each of said connecting panels including a central hinge line for folding said connecting panels inwardly between said main panels, said frame being convertible from a flat configuration in which said main panels are closely spaced with said connecting panels folded therebetween and an expanded state in which said connecting panels are unfolded and a volume is formed between said main panels and said connecting panels, wherein one or more of said connecting panels is formed by a panel section which is integral with said first main panel and extends to the other of said main panels, and is further formed by a leaf which is integral with said second main panel and overlaps a portion of said panel section.

8. The frame of claim 7, including a reinforcing flap hingedly connected to a free end of one or more of said panel sections in the first main panel, said flaps capable of extending through slots along a hinge line between the corresponding leaf and the other of said main panels so that the flaps extend within said volume and may be drawn into a perpendicular position with respect to the main panels and parallel to and adjacent the connecting panel to which it is connected so as to reinforce the connecting panel.

9. The frame of claim 8, including a string attached to a free end of each of said flaps, said string extending through a hole in the connecting panel to permit the string to be pulled to draw the flap into said perpendicular position with respect to the main panels during assembly of the frame.

10. The frame of claim 9, including a tab formed on the free end of each of said flaps, said tab capable of being positioned within a slot formed in the first main panel proximate a hinge line between said panel section and the first main panel.

11. The frame of claim 7, wherein some of said overlapping leaves and panel sections are secured together.

12. The frame of claim 11, wherein one pair of said overlapping leaves and panel sections are left unattached and a pull string is attached to the leaf of said one pair to form a trap door in said piñata frame.

13. A blank for constructing a piñata frame, comprising:

a first main panel having a polygonal shape with a plurality of straight edges;

a second main panel having a polygonal shape similar to said first main panel;

a bridge panel pivotally attached to adjacent parallel straight edges of said main panels, said bridge panel having a hinge line intermediate said first and second main panels and parallel to said adjacent straight edges;

a plurality of side panels extending from some of the straight edges of said first main panel, said side panels being pivotally coupled to said first main panel at said straight edges, each of said side panels having a hinge line approximately midway between the adjoining straight edge of said first main panel and an outer free edge of said side panel, each of said hinge lines on said side panels being shorter than the adjoining straight edge of said first main panel so as to form a trapezoid having angled side edges connecting said hinge line and adjoining straight edge, said angled side edges making an angle with said adjoining straight edge of said first main panel of no greater than the formula 90° * {1.0–(2.0/# of edges of said polygon)}; and a plurality of leaves extending from straight edges of said second main panel, said leaves having a long edge coincident with the adjoining straight edge of the second main panel, and an outer free edge shorter than said long edge.

14. The blank of claim 13, wherein each of said side panels comprises two trapezoidal sections each having a short edge parallel to a longer edge, with the sections being joined at their shorter edges to form said hinge line.

15. The blank of claim 13, wherein one or more of said side panels include a flap hingedly connected to a free end said side panel, each of said flaps corresponding to slots along a hinge line between a leaf and the second main panel, said slots sized to receive the flaps.

16. The blank of claim 15, including a pair of through holes centrally formed in said main panels.

17. The blank of claim 15, wherein said polygonal shape is an octagon and there are four reinforcing flaps and four slots.

18. A frame for a piñata, comprising:

a first main panel;

a second main panel similar in shape to said first main panel, said second main panel being disposed parallel to said first main panel;

a plurality of connecting panels joining the main panels at peripheral edges, said connecting panels comprising two trapezoid sections each having a short edge parallel to a longer edge, with the sections being joined at their shorter edges to form a central hinge line for folding said connecting panels between said main panels, said frame being convertible from a flat configuration in which said main panels are closely spaced with said connecting panels folded therebetween and an expanded state in which said connecting panels are unfolded and a volume is formed between said main panels and said connecting panels, wherein said main panels are similar shaped polygons with straight peripheral edges juxtaposed with the longer edges of an inner one of said trapezoidal sections, each of said trapezoidal sections has angled side edges connecting said long and short edges, said side edges making an angle with said long edge of no greater than the formula 90° * {1.0–{2.0/# of edges of said polygon)}.

19. A frame for a piñata, comprising:

a first main panel;

a second main panel similar in shape to said first main panel, said second main panel being disposed parallel to said first main panel;

a plurality of connecting panels joining the main panels at peripheral edges, said connecting panels comprising a central hinge line for folding said connecting panels between said main panels, said frame being convertible from a flat configuration in which said main panels are closely spaced with said connecting panels folded therebetween and an expanded state in which said connecting panels are unfolded and a volume is formed between said main panels and said connecting panels; and a reinforcing flap hingedly connected to a free end of one or more of said panel sections in the first main panel, said flaps capable of extending through slots along a hinge line between the corresponding leaf and the other of said main panels so that the flaps extend within said volume and may be drawn into a perpendicular position with respect to the main panels and parallel to and adjacent the connecting panel to which it is connected so as to reinforce the connecting panel, wherein one or more of said connecting panels is formed by a panel section which is integral with said first main panel and extends to the other of said main panels, and is further formed by a leaf which is integral with said other of the main panels and overlaps a portion of said panel section.

20. The frame of claim 19, including a string attached to a free end of each of said flaps, said string extending through a hole in the connecting panel to permit the string to be pulled to draw the flap into said perpendicular position with respect to the main panels during assembly of the frame.

21. The frame of claim 20, including a tab formed on the free end of each of said flaps, said tab capable of being positioned within a slot formed in the first main panel proximate a hinge line between said panel section and the first main panel.

22. A frame for a piñata, comprising:

a first main panel;

a second main panel similar in shape to said first main panel, said second main panel being disposed parallel to said first main panel;

a plurality of connecting panels joining the main panels at peripheral edges, said connecting panels comprising a central hinge line for folding said connecting panels between said main panels, said frame being convertible from a flat configuration in which said main panels are closely spaced with said connecting panels folded therebetween and an expanded state in which said connecting panels are unfolded and a volume is formed between said main panels and said connecting panels, wherein one or more of said connecting panels is formed by a panel section which is integral with said first main panel and extends to the other of said main panels, and is further formed by a leaf which is integral with said other of the main panels and overlaps a portion of said panel section, and wherein some of said overlapping leaves and panel sections are secured together, and one pair of said overlapping leaves and panel sections are left unattached and a pull string is attached to the leaf of said one pair to form a trap door in said piñata frame.

23. A frame for a piñata, comprising:

a first main panel;

a second main panel similar in shape to said first main panel, said second main panel being disposed parallel to said first main panel;

a plurality of connecting panels joining the main panels at bends defining peripheral edges, each of said connecting panels including a central hinge line for folding said connecting panels between said main panels, said frame being convertible from a flat configuration in which said main panels are closely spaced with said connecting panels folded therebetween and an expanded state in which said connecting panels are unfolded and a volume is formed between said main panels and said connecting panels; and at least one flap attached to said frame between said connecting panels and said main panels with an attached string extending outwardly of said frame which enables said flap to unfold said connecting panels and, thereby, to expand said main panels to form said volume.

* * * * *